United States Patent [19]

Patz

[11] Patent Number: 4,614,419

[45] Date of Patent: Sep. 30, 1986

[54] PRE-DEVELOPMENT INDUCTIVE CHARGING OF DEVELOPER MATERIAL

[75] Inventor: Herbert S. Patz, Wayland, Mass.

[73] Assignee: Xerox Corporation, Stamford, Conn.

[21] Appl. No.: 652,251

[22] Filed: Sep. 20, 1984

[51] Int. Cl.[4] ..... G03G 15/08; G03G 15/09

[52] U.S. Cl. ..... 355/3 DD; 118/657

[58] Field of Search ..... 355/3 R, 3 DD, 14 D; 118/656, 657, 658

[56] References Cited

U.S. PATENT DOCUMENTS

| | | | |
|---|---|---|---|
| 3,332,396 | 7/1967 | Gundlach | 355/3 DD X |
| 3,428,025 | 2/1969 | Sullivan, Jr. | 118/637 |
| 3,739,748 | 6/1973 | Rittler et al. | 355/3 DD X |
| 3,914,460 | 10/1975 | Maksymiak | 355/3 DD X |
| 4,382,420 | 5/1983 | Ohnuma et al. | 355/3 DD X |

*Primary Examiner*—Fred L. Braun

*Attorney, Agent, or Firm*—H. Fleischer; J. E. Beck; R. Zibelli

[57] ABSTRACT

An apparatus in which a latent image recorded on an image receiving member is developed with developer material. A conductive developer roller transports the developer material into a development zone for depositing developer material onto the latent image recorded on the image receiving member. The developer material is attracted from the developer roller to an insulating belt in a pre-development zone. The insulating belt inductively charges the developer material which is subsequently transferred back to the developer roller. The inductively charged developer material is then advanced to the development zone for developing the latent image recorded on the image receiving member.

22 Claims, 3 Drawing Figures

PRE-DEVELOPMENT INDUCTIVE CHARGING OF DEVELOPER MATERIAL

This invention relates generally to an electrophotographic printing machine, and more particularly concerns an apparatus for developing a latent image recorded on a photoconductive surface.

Generally, the process of electrophotographic printing includes charging a photoconductive surface to a substantially uniform potential. The charged portion of the photoconductive surface is exposed to a light image of an original document being reproduced. This records an electrostatic latent image on the photoconductive surface corresponding to the informational areas within the original document. After the electrostatic latent image is recorded on the photoconductive surface, the latent image is developed by bringing a developer material into contact therewith. This forms a toner powder image on the photoconductive surface. Subsequently, the toner powder image is transferred to a copy sheet. Finally, the powder image is heated to permanently affix it to the copy sheet in image configuration.

In the foregoing printing machine, a development system is employed to deposit developer material onto the photoconductive surface. Generally, the developer material comprises toner particles which are mixed with coarser carrier granules. Typical toner particles are made from a thermo-plastic material while the carrier granules are made from a magnetic material. Alternatively, single component developer materials having magnetic particles may be employed. One type of development apparatus employing a single component developer material is described in U.S. Pat. No. 2,846,333 issued to Wilson in 1958. When a single component developer material is used, it is highly desirable to uniformly meter a thin layer of the developer material onto the developer roller. This significantly improves development. A development system using a thin layer of developer material is described in co-pending U.S. patent application Ser. No. 478,425 filed by Bares on Mar. 24, 1983, now U.S. Pat. No. 4,518,245. It has been found that not all of the developer material is deposited on the latent image. In order to increase the percentage of the developer material deposited on the latent image, it is desirable to insure that all of the developer material entering the development zone is appropriately charged. Various approaches have been devised for insuring that the developer material entering the developer zone has the appropriate charge thereon. The following disclosure appears to be relevant:

U.S. Pat. No. 3,428,025
Patentee: Sullivan, Jr.
Issued: Feb. 18, 1969.

The relevant portion of the foregoing disclosure may be briefly summarized as follows:

Sullivan, Jr. discloses a development system having a bucket conveyor system for transporting a developer material from a sump to an elevated location. The developer material then falls under the influence of gravity through a chute onto a grounded conductive screen. The mesh of the screen is sufficiently fine to prevent the passage of carrier granules therethrough while permitting toner particles to pass therethrough. Pin type electrodes are positioned adjacent the screen. The electrodes are electrically biased to cause a sustained electrical breakdown between the screen and electrodes for charging toner particles flowing across the screen. As the toner particles become charged, they are repelled from the electrodes, through the screen onto the electrostatic latent image recorded on the photoconductive surface for its development.

In accordance with one aspect of the present invention, there is provided an apparatus for developing a latent image recorded on an image receiving member with developer material. The apparatus includes conductive means transporting the developer material into a development zone for depositing developer material onto the latent image recorded on the image receiving member. Insulative means charge the developer material being advanced by the transporting means into the development zone.

Pursuant to another aspect of the present invention, there is provided an electrophotographic printing machine of the type having a photoconductive member arranged to have a latent image recorded thereon developed with a developer material. The printing machine includes conductive means transporting the developer material into a development zone for depositing developer material onto the latent image recorded on the photoconductive member. Insulative means are provided for charging the developer material being advanced by the transporting means into the development zone.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intented to cover all alternatives, modifications, and equivalents as may be included within the spirit and scope of the invention as defined by the appended claims.

Figure 1:
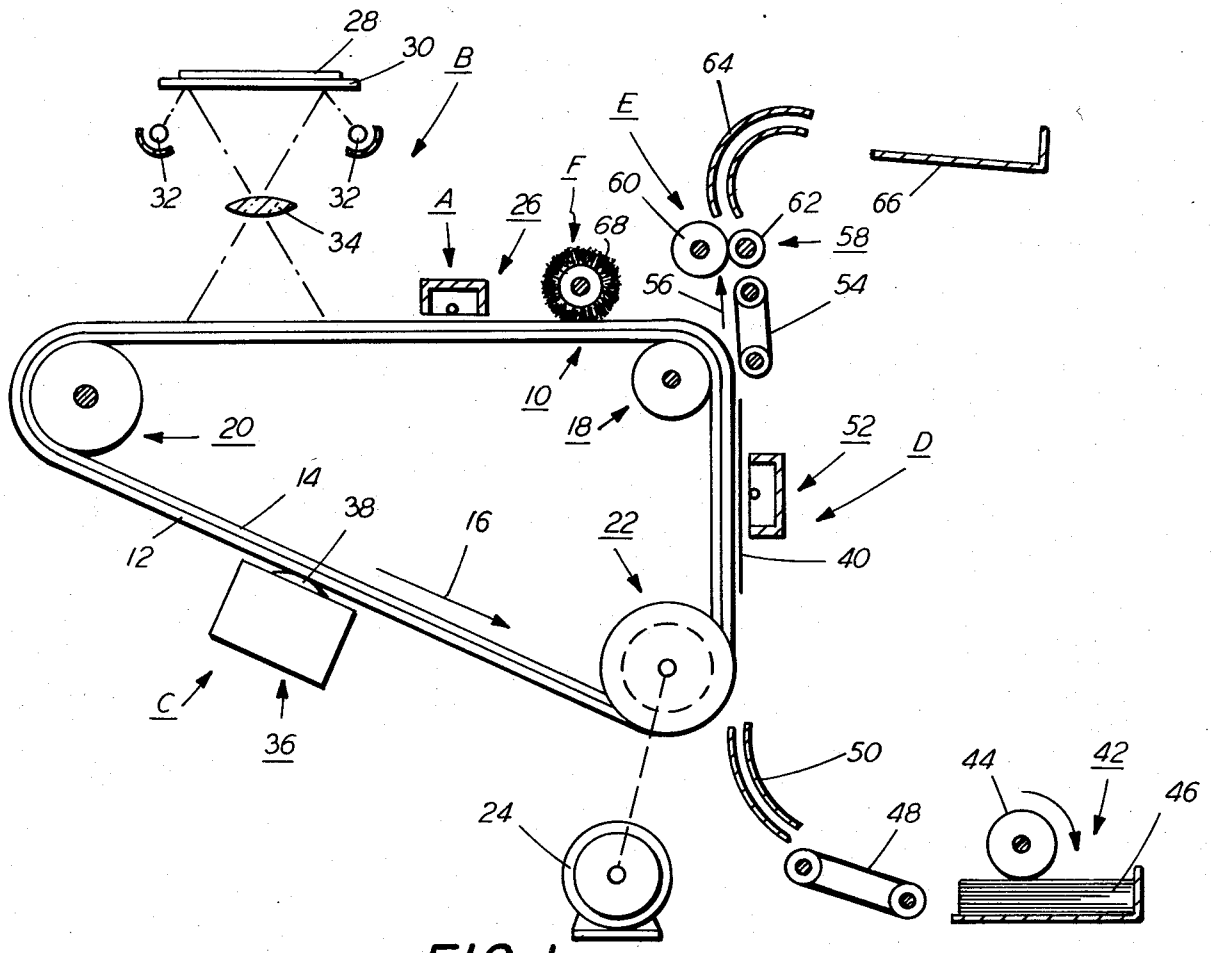
FIG. 1 is a schematic elevational view depicting an illustrative electrophotographic printing machine incorporating the features of the present invention therein.

For a general understanding of the features of the present invention, reference is made to the drawings. In the drawing, like reference numerals have been used throughout to designate identical elements. FIG. 1 schematically depicts the various components of an illustrative electrophotographic printing machine incorporating the development apparatus of the present invention therein. It will become evident from the following discussion that this apparatus is equally well suited for use in a wide variety of electrostatographic printing machines, and is not necessarily limited to its application to the particular embodiment depicted herein.

In the illustrative electrophotographic printing machine, as shown in FIG. 1, a belt 10 having a photoconductive surface 12 deposited on a conductive substrate 14 moves in the direction of arrow 16. Preferably, the conductive substrate comprises a transparent support, such as a poly (ethyleneterpethialate) cellulose acetate or other suitable photographic film support, typically having coated thereon a transparent conductive coating such as high vacuum evaporated nickel, cuperous iodiode, or any suitable conducting polymer. The conductive support is, in turn, overcoated with a photoconductive layer typically comprising a binder and an organic photoconductor. A wide variety of organic photoconductors may be employed. For example, an organic amine photoconductor or a polyarlakene photoconductor may be used. However, one skilled in the art will appreciate that any suitable organic photoconductor compatible with a transparent conductive substrate may be utilized in the present invention. Various types of photoconductors are described in U.S. Pat. No. 3,734,724 issued to York in 1973, the relevant portion thereof being hereby incorporated into the present application. In the exemplary electrophotographic printing machine, the photoconductive layer has an electrostatic charge of a negative polarity recorded thereon with the charge on the developer material being of a positive polarity.

With continued reference to FIG. 1, belt 10 moves in the direction of arrow 16 to advance successive portions of photoconductive surface 12 through the various processing stations disposed about the path of movement thereof. As shown, belt 10 is entrained about stripping roller 18, tension roller 20 and drive roller 22. Drive roller 22 is mounted rotatably and in engagement with belt 10. Motor 24 rotates drive roller 22 to advance belt 10 in the direction of arrow 16. Drive roller 22 is coupled to motor 24 by suitable means such as a drive belt. Drive roller 22 includes a pair of opposed space edge guides. The edge guides define a space therebetween which determines the desired path of movement of belt 10. Belt 10 is maintained in tension by a pair of springs (not shown) resiliently urging tension roller 20 against belt 10 with the desired spring force. Both stripping roller 18 and tension roller 20 are mounted rotatably. These rollers are idlers which rotate freely as belt 10 moves in the direction of arrow 16.

Initially, a portion of belt 10 passes through charging station A. At charging station A, a corona generating device, indicated generally by the reference numeral 26, charges photoconductive surface 12 of belt 10 to a relatively high, substantially uniform potential having a negative polarity. One skilled in the art will appreciate that the polarity of the charge on the photoconductive surface depends upon the selected photoconductive material, and a suitable photoconductive material may be utilized wherein a positive polarity is applied rather than a negative polarity.

Next, the charged portion of photoconductive surface 12 advances through exposure station B. At exposure station B, an original document 28 is positioned face down upon a transparent platen 30. Lamps 32 flash light rays onto original document 28. The light rays reflected from original document 28 are transmitted through less 34 forming a light image thereof. Lens 34 focuses the light image into the charged portion of photoconductive surface 12 to selectively dissipate the charge thereon. This records an electrostatic latent image on the photoconductive surface having a negative polarity which corresponds to the informational areas contained within original document 28. Thereafter, belt 10 advances the electrostatic latent image recorded on photoconductive surface 12 to development station C.

At development station C, the magnetic brush development system of the present invention, indicated generally by the reference numeral 36, transports a single component developer material into contact with the latent image recorded on photoconductive surface 12. The developer material is attracted from developer roller 38 to the latent image forming a powder image on photoconductive surface 12 of belt 10. By way of example, the developer material may comprise magnetite particles dispersed in an insulating resin. The magnetite comprises 40 to 50% by weight of each developer particle with the resin being the remainder of the weight thereof. Any suitable insulating resin typically employed for developer materials used in electrophotographic printing machines may be utilized. One skilled in the art will appreciate that the system need not necessarily require the utilization of a magnetic developer material. Any suitable non-magnetic developer material may be employed as well. The detailed structure of development system 36 will be described hereinafter with reference to FIGS. 2 and 3.

After development, belt 10 advances the powder image to transfer station D. At transfer station D, a sheet of support material 40 is moved into contact with the powder image. By way of example, the sheet of support material may be paper. The copy paper is advanced to transfer station D by a sheet feeding apparatus, indicated generally by the reference numeral 42. Preferably, sheet feeding apparatus 42 includes a feed roller 44 contacting the uppermost sheet of stack 46. Feed roll 44 rotates to advance the sheet from stack 46 onto conveyor 48. Conveyor 48 transports the sheet into chute 50 which guides sheet 40 into contact with photoconductive surface 12 of belt 10 in a timed sequence so that the powder image developed thereon contacts the advancing sheet 40 at transfer station D.

Transfer station D includes a corona generating device 52 which sprays negative ions onto the backside of sheet 40. In this way, sheet 40 is charged to an opposite polarity from that of the developer material adhering to photoconductive surface 12 of belt 10. The developer material is attracted from photoconductive surface 12 to sheet 40.

After the developer material has been transferred to sheet 40, conveyor 54 advances the sheet in the direction of arrow 56 to fusing station E. Fusing station E includes a fuser assembly, indicated generally by the reference numeral 58, which permanently affixes the transferred powder image to copy sheet 40. Preferably, fuser assembly 58 includes a heated fuser roll 60 and a back-up roll 62. Sheet 40 passes between fuser roll 60 and back-up roll 62 with the powder image contacting fuser roll 60. In this manner, the powder image is permanently affixed to sheet 40. After fusing, chute 64 guides the advancing sheet to catch tray 66 for subsequent removal from the printing machine by the operator.

Invariably after the copy sheet is separated from photoconductive surface 23 of belt 10, some residual particles remain adhering thereto. These residual particles are removed from photoconductive surface 12 at cleaning station F. Cleaning station F includes a pre-clean corona generating device (not shown) and a rotatably mounted fiberous brush 68 in contact with the photoconductive surface 12. The pre-clean corona generating device neutralizes the charge attracting the particles to the photoconductive surface. These particles are then cleaned from the photoconductive surface by the rotation of brush 68 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of the illustrative electrophotographic printing machine incorporating the features of the present invention therein.

Figure 2:
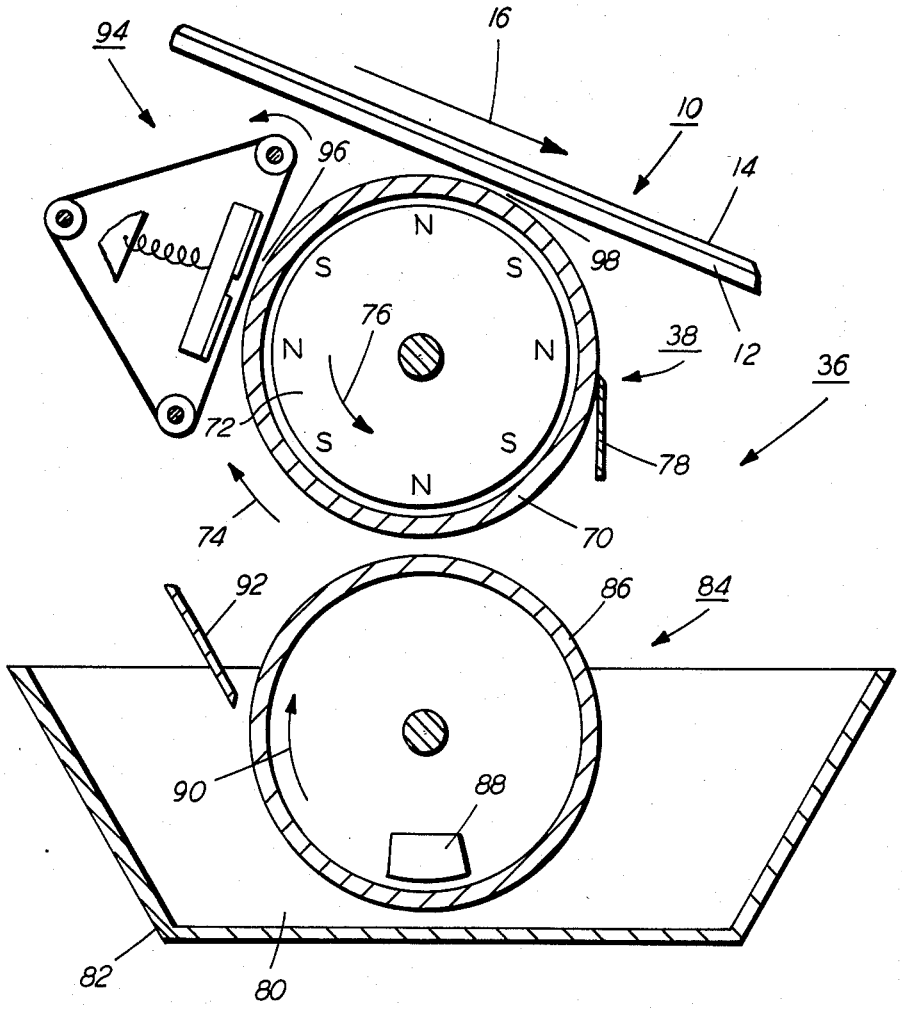
FIG. 2 is an elevational view showing schematically the development apparatus used in the FIG. 1 printing machine.

Referring now to FIG. 2, there is shown the features of the development apparatus of the present invention in greater detail. As depicted thereat, development apparatus 36 includes a developer roller, indicated generally by reference numeral 38. Developer roller 38 includes a non-magnetic, electrically conductive tubular member 70. Preferably, tubular member 70 is made from aluminum. Tubular member 70 is interfit telescopically over magnetic member 72. Preferably, magnetic member 72 is made from barium ferrite in the form of a cylindrical member having magnetic poles impressed upon the circumferential surface thereof. By way of example, belt 10 moves in the direction of arrow 16 at a speed of about 10 inches per second. This speed is substantially constant. Tubular member 70 rotates in the direction of arrow 74 at an angular velocity of 720 revolutions per minute. The diameter of tubular member 70 is such that the tangential velocity of tubular member 70 in the development zone, i.e. where the developer material contacts the photoconductive surface of belt 10, is in the same direction as the movement of belt 10. Preferably, the tangential velocity of tubular member 70 is 47 inches per second. Magnetic member 72 rotates in the direction of arrow 76 at an angular velocity about 1000 revolutions per minute. By way of example, tubular member 70 may be coated with a layer of material capable of charging the developer material particles by contact electrification ranging in the thickness from 1 micron to 500 microns. A suitable material is a polytetrafluorethylene based resin such as Teflon, a trademark of the Dupont Corporation or a polyvinladine based resin such as Kynar, a trademark of the Penwalt Corporation, in combination with carbon black. The thickness of the brush of marking particles adhering to tubular member 70 is equal to or less than 50 microns. A flexible blade 78 has the free end portion thereof in contact with tubular member 70 to scrape the unused developer particles from tubular member 70. By way of example, blade 78 may be made from a suitable spring steel. The developer material particles are advanced to tubular member 70 from chamber 80 of housing 82 by a metering roller, indicated generally by the reference numeral 84. Metering roller 84 includes a metering sleeve 86. Preferably, metering sleeve 86 is non-magnetic and made from stainless steel. A plurality of depressed regions are disposed on the exterior circumferential surface thereof for transporting the developer material from chamber 80 of housing 82 to developer roll 38. Magnet 88 is positioned interiorly of and spaced from sleeve 86. Preferably, magnet 88 is stationary and positioned such that the developer material particles in chamber 80 of housing 82 are attracted to the exterior circumferential surface of sleeve 86. Sleeve 86 rotates in the direction of arrow 90 to transport the developer material to developer roll 38. As shown, sleeve 86 rotates in the same direction as that of tubular member 70. By way of example, sleeve 86 rotates at an angular velocity of about one revolution per minute. A metering blade 92 having the free end portion thereof contacting sleeve 86, regulates the quantity of developer material particles being transported by sleeve 86 to tubular member 70. Preferably, metering blade 92 is flexible and made from spring steel. The inductive charging system of the present invention, indicated generally by the reference numeral 94, is positioned adjacent tubular member 70 in pre-development zone 96. The detailed structure of inductive charging system 94 will be described hereinafter with reference to FIG. 3. In operation, developer material, metered from metering roller 84 to developer roller 38, is attracted to inductive charging system 94 in pre-development zone 96. After being inductively charged, the developer material is transferred back to developer roller 38 from inductive charging system 94 in pre-development zone 96. Thereafter, the inductively charged developer material is advanced on developer roller 38 to development zone 98 where it is deposited on the latent image recorded on the photoconductive surface of belt 10.

Figure 3:
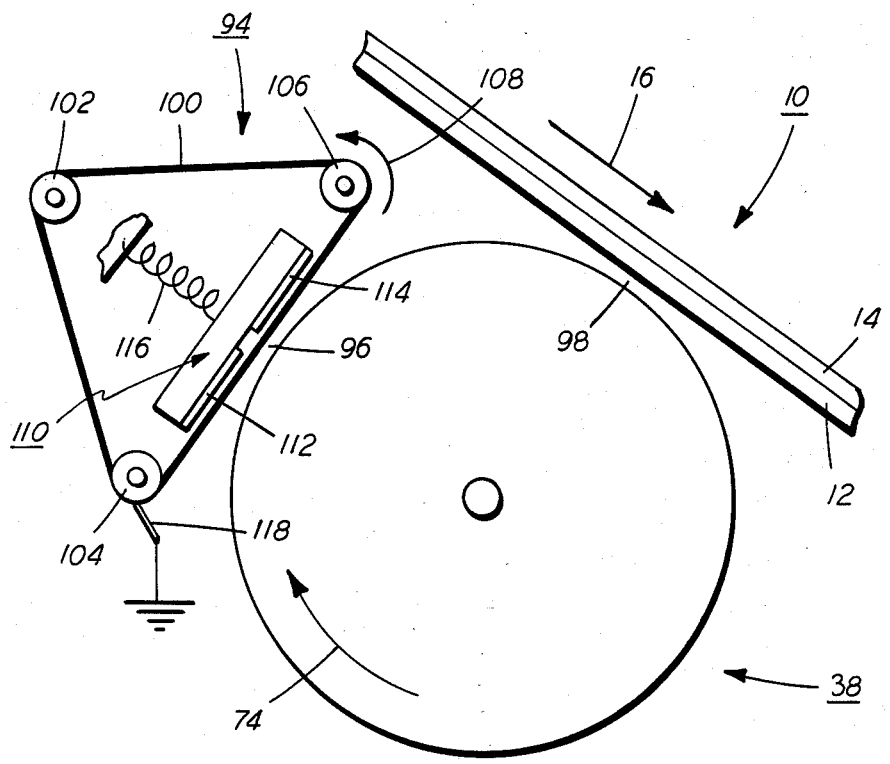
FIG. 3 is an elevational view showing the developer roller and the system for inductively charging the developer material in the pre-development zone.

Referring now to FIG. 3, there is shown the detailed structure of inductive charging system 94. Inductive charging system 94 includes an insulating belt 100 entrained about spaced rollers 102, 104 and 106. Roller 102, coupled to a motor, is driven thereby. In this way, insulating belt 100 moves in the direction of arrow 108. Belt 100 moves at a slower speed than the tangential velocity of developer roller 38. Thus, belt 100 moves at a velocity less than 47 inches per second. One skilled in the art will appreciate that belt 100 may even be stationary. By way of example, belt 100 may be made from Mylar, a trademark of the Dupont Corporation. An electrode, indicated generally by the reference numeral 110, is positioned interiorly of belt 100 opposed from developer roller 38 in pre-development zone 96. Electrode 110 includes a first portion 112 electrically insulated from a second portion 114. Developer roller 38 is electrically biased to a negative potential of about 350 volts. The first electrode portion 112 is negatively biased to an electrical potential of about 500 volts. Electrode portion 114 is electrically biased to a positive potential of about 500 volts. A spring 116 resiliently urges electrode 110 toward developer roller 38. The resilient force applied on electrode 110 by spring 116 insures that electrode 110 presses against belt 100 which, in turn, contacts developer material passing through pre-development zone 96. An electrically grounded metal blade 118 presses belt 100 against an electrically grounded roller 104 to discharge the insulating belt during each successive cycle. In operation, developer roller 38 advances the developer material in the direction of arrow 74. Electrode portion 112 is electrically biased to attract the developer material thereto as it enters pre-development zone 96. Once the developer material is developed onto belt 100, it increases its low charge by inductive charging while in the field of electrode portion 112. As the developer material leaves electrode portion 112, it enters the electrical field produced by electrode portion 114. Electrode portion 114 is electrically biased such that as the developer material enters its electrical field, it is transferred back to developer roller 38. The developer material is then transported on developer roller 38 to development zone 98 where it is deposited on the latent image recorded on the photoconductive surface of belt 10 moving in the direction of arrow 16. Alternatively, electrode 110 may be a single electrode rather than two electrodes insulated from one another. In this latter configuration, electrode 110 is electrically biased by an AC voltage. Under these circumstances, the developer material moves back and forth in the pre-development zone, and is only charged significantly when on insulating belt 100. Still another alternative is to electrically bias each of the electrode portions with a DC voltage having an AC voltage superimposed thereover.

In recapitulation, in the development apparatus of the present invention, a thin layer of developer material is transported between an insulating surface and a conducting surface with the conducting surface moving faster than the insulating surface. An electrical field is created in the pre-development zone by applying a potential between the conducting surface and an electrode disposed behind the insulating surface. The developer material is attracted to the insulating surface. When the developer material is on the insulating surface, it is inductively charged. After the developer material is inductively charged, it is transferred back to the developer roll. The developer roller now advances the inductively charged developer material to the development zone. In the development zone, the developer material is deposited onto the latent image recorded on the photoconductive surface to form a powder image thereon.

It is, therefore, evident that there has been provided in accordance with the present invention, an apparatus for developing an electrostatic latent image that fully satisfies the aims and advantages hereinbefore set forth. While this invention has been described in conjunction with a preferred embodiment thereof, it is evident that many alternatives, modifications and variations will be apparent to those skilled in the art. Accordingly, it is intended to embrace all such alternatives, modifications, and variations which fall within the spirit and broad scope of the appended claims.

I claim:

1. An apparatus for developing a latent image recorded on an image receiving member with developer material, including:

conductive means for transporting the developer material into a development zone for depositing developer material onto the latent image recorded on the image receiving member; and insulative means positioned closely adjacent said conductive means defining a pre-development zone through which the developer material passes before entering the development zone, for charging the developer material being advanced by said conductive means into the development zone.

2. An apparatus according to claim 1, wherein said conductive means moves at a greater velocity than said insulative means.

3. An apparatus according to claim 2, wherein said insulative means includes an insulative belt.

4. An apparatus according to claim 3, wherein said insulative means includes means for generating an electrical field in the pre-development zone between said insulative belt and said conductive means to first attract the developer material from said conductive means to said insulative belt and to transfer the developer material attracted to said insulative belt back to said conductive means with a charge induced thereon.

5. An apparatus according to claim 4, wherein said generating means includes:

an electrode disposed on the side of said insulative belt opposed from said conductive means in the pre-development zone; and means for electrically biasing said electrode to generate the electrical field in the pre-development zone.

6. An apparatus according to claim 5, wherein:

said electrode includes a first electrode portion and a second electrode portion with said first electrode portion being electrically insulated from said second electrode portion; and said electrical biasing means electrically biases said first electrode portion to generate a first electrical field between said insulative belt and said conductive means to attract the developer material from said conductive means to said insulative belt and said electrical biasing means electrically biases said second electrode portion to generate a second electrical field between said insulative belt and said conductive means to transfer the developer material back to said conductive means from said insulative belt with a charge induced thereon.

7. An apparatus according to claim 6, wherein the polarity of the first electrical field is opposite to the polarity of the second electrical field.

8. An apparatus according to claim 5, wherein said electrical biasing means electrically biases said electrode to generate an alternating electrical field in the pre-development zone.

9. An apparatus according to claim 5, wherein said conductive means includes:

an electrically conductive tubular member; and an elongated magnetic member disposed interiorly of and spaced from said tubular member for attracting the developer material to the exterior surface of said tubular member.

10. An apparatus according to claim 9, further including:

a housing defining a chamber for storing a supply of developer material therein;

means, closely spaced to said tubular member, for advancing the developer material from the chamber in said housing to said tubular member; and means for regulating the quantity of developer material being advanced by said advancing means to said tubular member.

11. An apparatus according to claim 10, further including means for removing the developer material from said tubular member after said tubular member transports the developer material through the development zone.

12. An electrophotographic printing machine of the type having a photoconductive member arranged to have a latent image recorded thereon developed with a developer material, wherein the improvement includes:

conductive means for transporting the developer material into a development zone for depositing developer material onto the latent image recorded on the photoconductive member; and insulative means, positioned closely adjacent said conductive means defining a pre-development zone through which the developer material passes before entering the development zone, for charging the developer material being advanced by said conductive means into the development zone.

13. A printing machine according to claim 12, wherein said conductive means moves at a greater velocity than said insulative means.

14. A printing machine according to claim 13, wherein said insulative means includes an insulative belt.

15. A printing machine according to claim 14, wherein said insulative means includes means for generating an electrical field in the pre-development zone between said insulative belt and said conductive means to first attract the developer material from said conductive means to said insulative belt and to transfer the developer material attracted to said insulative belt back to said conductive means with a charge induced thereon.

16. A printing machine according to claim 15, wherein said generating means includes:

an electrode disposed on the side of said insulative belt opposed from said conductive means in the pre-development zone; and means for electrically biasing said electrode to generate the electrical field in the pre-development zone.

17. A printing machine according to claim 16, wherein:

said electrode includes a first electrode portion and a second electrode portion with said first electrode portion being electrically insulated from said second electrode portion; and said electrical biasing means electrically biases said first electrode portion to generate a first electrical field between said insulative belt and said conductive means to attract the developer material from said conductive means to said insulative belt and said electrical biasing means electrically biases said second electrode portion to generate a second electrical field between said insulative belt and said conductive means to transfer the developer material back to said conductive means from said insulative belt with a charge induced thereon.

18. A printing machine according to claim 17, wherein the polarity of the first electrical field is opposite to the polarity of the second electrical field.

19. A printing machine according to claim 16, wherein said electrical biasing means electrically biases said electrode to generate an alternating electrical field in the pre-development zone.

20. An printing machine according to claim 16, wherein said conductive means includes:

an electrically conductive tubular member; and an elongated magnetic member disposed interiorly of and spaced from said tubular member for attracting the developer material to the exterior surface of said tubular member.

21. A printing machine according to claim 20, further including:

a housing defining a chamber for storing a supply of developer material therein;

means, closely spaced to said tubular member, for advancing the developer material from the chamber in said housing to said tubular member; and means for regulating the quantity of developer material being advanced by said advancing means to said tubular member.

22. A printing machine according to claim 21, further including means for removing the developer material from said tubular member after said tubular member transports the developer material through the development zone.

* * * * *